United States Patent [19]

Eppensteiner et al.

[11] 4,064,034

[45] Dec. 20, 1977

[54] ANODE STRUCTURE FOR WIRE AND STRIP LINE ELECTROPLATING

[75] Inventors: Frederick Walter Eppensteiner, Southfield; R. E. Woehrle, Birmingham, both of Mich.

[73] Assignee: M & T Chemicals Inc., Greenwich, Conn.

[21] Appl. No.: 357,023

[22] Filed: May 3, 1973

Related U.S. Application Data

[62] Division of Ser. No. 227,305, Feb. 17, 1972, which is a division of Ser. No. 28,758, April 15, 1970, Pat. No. 3,691,049.

[51] Int. Cl.[2] ..... C25D 17/00; C25D 17/10

[52] U.S. Cl. ..... 204/286; 204/206; 204/297 R

[58] Field of Search ..... 204/285, 287, 290 F, 204/297 R, 297 W, 286, 206

[56] References Cited

U.S. PATENT DOCUMENTS

| | | | |
|---|---|---|---|
| 2,509,304 | 5/1950 | Klein | 204/206 |
| 2,569,577 | 10/1951 | Reading | 204/206 |
| 2,610,145 | 9/1952 | Wilson | 204/206 |
| 2,610,146 | 9/1952 | Kompart | 204/206 |
| 2,708,181 | 5/1955 | Holmes et al. | 204/28 |
| 2,865,832 | 12/1958 | Pitzer | 204/222 |
| 3,531,378 | 9/1970 | Croset | 204/14 N |

*Primary Examiner*—T. M. Tufariello

*Attorney, Agent, or Firm*—Kenneth G. Wheeless; Robert P. Auber; Robert Spector

[57] ABSTRACT

Methods and apparatus are provided for high speed wire and/or strip line electroplating of metals such as tin and zinc on a metal substrate by utilizing in the anode assembly therefor a combination of the plating metal as the anode and an anode support comprised essentially of a member selected from the group consisting of tantalum, niobium, and mixtures thereof.

6 Claims, 2 Drawing Figures

ANODE STRUCTURE FOR WIRE AND STRIP LINE ELECTROPLATING

Figure 2:
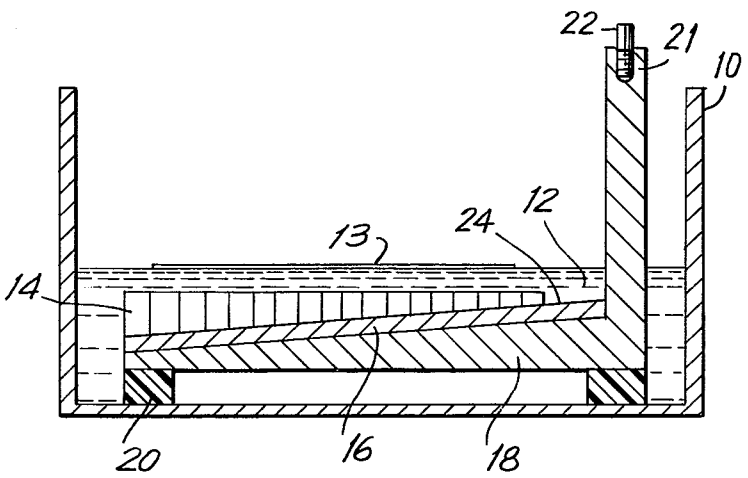

This application is a divisional application of copending application Ser. No. 227,305, filed Feb. 17, 1972, which in turn is a divisional application of the parent application Ser. No. 028,758, filed Apr. 15, 1970, which is now U.S. Pat. No. 3,691,049.

Generally speaking, this invention relates to electroplating of a metal substrate such as steel in the form of a wire or a strip, with a plating metal including such metals as zinc and tin. More particularly, this invention relates to the high speed electroplating of such metal substrates in the form of wire or strips in a manner so that the final strip is plated with a thickness of metal appropriate for certain commercial applications while at the same time the plating process is sufficiently fast and efficient to produce the finally coated metal wire or strip to be commercially competitive with such prior art processes as hot-dip galvanizing of strip steel, for example.

As is well known, the automobile industry uses large quantities of steel sheeting for various parts of an automobile. This steel sheeting is first galvanized in order to protect the steel from oxidation especially for those parts which are exposed to an oxidation environment from salt spray, moisture, etc. In the usual manner, this steel sheeting is coated with zinc by what is known as the "hot-dip" method in which continuous strips of the steel are run over rollers and through a molten bath of zinc for coating the steel. However, this results in certain problems in that the galvanized steel produced by the hot-dip method presents a surface which is unsatisfactory for application of the final paint to the outside of an automobile, as well as appliances, for example, in which sheet steel may be used. Therefore, many methods have been devised for coating only one side of the strip steel by the hot-dip method. For example, one method is to stop-off one side of the steel strip with a substance which prevents one side of the steel strip from being coated with zinc when it passes through the molten zinc bath. This stop-off coating is later stripped from the steel strip so that the final product is a steel strip having a zinc coating only on one side. The uncoated side is then arranged to be the outside surface for automobiles, for example, where applications of paint are made on the final assembled parts of the automobile.

Other methods for avoiding the coating of one side of the continuous steel strip include applying a doctor blade to one side of the steel strip as it exits from the molten zinc bath to scrape off the molten zinc coating on the one side prior to the time that the coating hardens. Usually this doctor blade is utilized in conjunction with a flame application to the coating in order to maintain it in a liquid state long enough for the doctor blade to be effective in removing the zinc coating from the one side of the steel strip.

Whereas the above methods serve the useful purpose of removing the zinc coating from one side of the steel strip so that a painted surface may be applied which is attractive esthetically, certain difficulties may arise in the utilization of the "hot-dip method" in the first place in that the steel strip and/or wire, when it is passed through the molten metallic bath for coatng, is subjected to erratic conditions so as to adversely effect the surface of the strip and/or wire for subsequent painting application. Thus, several problems may arise in the utilization of the usual hot-dip method for galvanizing steel strip which present expensive difficulties later on in the application of a painted surface to certain portions of the steel strip which are utilized in automobile bodies and/or appliances, for example, where an esthetically appropriate surface is desired.

One of the prior art means for overcoming these objections which may arise in the utilization of the hot-dip method for the application of, for example, a zinc coating in a strip line operation is the utilization of the electroplating process for application of zinc, for example, to steel strips. Such a method has proved satisfactory for certain applicaions because the electroplating process applied a coating in a manner which is much more uniform and even then is the case with the hot-dip method, thus providing a surface which is protected on one side from the deteriorating effects of oxidation of the steel strip material while presenting on the opposite side an even surface which will take a final paint coating which is esthetically desirable in appearance.

However, the prior art electroplating methods have proved unsatisfactory in certain instances in which mass produced quantities of steel strip are desired for such applications as automobile parts. For example, when utilizing the usual zinc sulfate bath for electrogalvanizing steel strip, the thickness of the coating is about 0.000084 inches. The reason for this is that the current density which must be utilized with a zinc sulfate bath is such that this is the thickness which is the most economical from such as operation. This thickness is undesirable for automotive purposes, for example, merely because it does not provide satisfactory protection from the oxidation environment ordinarily encountered by automotive parts. The desired thickness of such a coating is about 0.00067 inches which would be satisfactory for automotive needs, for example. However, in order to provide such a coating thickness the existing electrozinc lines for electroplating zinc on steel would have to be slowed down to between about ⅛th to about 1/10th the present speed. With such an arrangement, the cost in mass producing the amount of coated steel strip necessary is prohibitive except for certain selective applications.

One way to overcome this problem of low current density causing extremely slow speeds in order to obtain the proper thickness of coating is to utilize a bath with higher limiting current density and higher conductivity than can be obtained with the usual zinc sulfate bath. As well known, a chloride zinc bath can be operated at much higher current densities than is the case with the usual zinc sulfate bath. Because of the higher current densities, the strip line can be operated at a much faster rate while still achieving a desirably thick plate. However, when such a bath is used with a current density which would be satisfactory for providing the proper production output and while simultaneously obtaining the proper thickness of coating, chlorine gas evolution takes place from immersed insoluble anode supports which is so extreme that the whole operation becomes useless merely because it is impossible for anyone to be in even the same building with such an operation.

Thus, the problem arises that if the more desirable chloride zinc bath is to be utilized, the bath operation must be run at an extremely low current density level in order to avoid the problem of chlorine gas evolution, even though a chloride zinc bath may be operated at a much more efficient and higher current density to provide the desired thickness of coating.

As is well known, in some strip line operations, the anode, in this case zinc, is disposed along the bottom of the plating tank containing the electrolyte solution. The anode must be supported and in the past carbon has been utilized as the support for the anode. With the more desirable, commercially acceptable zinc sulfate bath no problem arises merely because there is no chlorine evolution. However, with such a bath the highest operating current density is still so low that in order to provide the proper plating thickness on the steel strip the cost of the operation becomes prohibitive for mass production utilization. However, when the chloride zinc bath is used, by contrast, there is electrochemical reaction between the bath and the carbon anode support at high current densities, thus producing the chlorine evolution noted above. In attempting to electroplate zinc in a strip line operation neither bath has proved completely satisfactory for commercial operations.

By contrast, and quite unexpectedly, it has now been found in accordance with this invention that in strip line electroplating by combining in the anode structure for the plating operation, the metal to be plated as the anode with an anode support comprises essentially of one of the members selected from the group consisting of tantalum and niobium, and mixtures thereof, that the problems which arise from the utilization of the prior art substances such as carbon for the anode support are overcome. For example, in zinc electroplating, with the utilization of the zinc anode in combination with a tantalum anode support, a zinc chloride bath may be used with no evolution of chlorine gas. With such an arrangement, therefore, much higher operating current densities may be utilized in the absence of injurious chlorine gas evolution. The speed of the strip line operation is speeded up, accordingly, while simultaneously producing, because of the much higher operating current densities, a plating thickness which is appropriate for protecting the final plated strip in the environment in which it is to be utilized.

Whereas no specific reason has been found for the results obtained herein in which the combination of zinc anode with a tantalum and/or niobium support in combination with a zinc chloride bath does not produce chlorine evolution, it can be theorized that the tantalum reacts with the bath to provide an oxide formation at the tantalum-solution interface so as to prevent any further current from passing through this interface. Thus, the current takes the course of least resistance and passes to the zinc anode. This may be borne out by the fact that if the tantalum-solution interface is contacted with zinc metal, current immediately begins to pass between the two metals, but as soon as the contact is broken the current immediately stops. However, when observing the tantalum surface nothing is apparent on the surface which would indicate any oxide coating. Thus, it can be theorized that an extremely thin frangible oxide coating is formed at the interface which may be broken momentarily when the surface is contacted with zinc and which immediately repairs itself when the contact is ended.

When zinc is the metal which is being deposited, in accordance herewith, it should be understood that although a chloride zinc bath would ordinarily be utilized because much higher current densities can be employed in conjunction with such as arrangement for much rapid plating operations, the combination of a zinc anode with an anode support consisting essentially of one of the members selected from the group consisting of tantalum, niobium, and mixtures thereof also may be utilized in strip line electroplating of zinc with any acid zinc bath such as, for example, a zinc sulfate bath. Obviously, there will be instances where such a bath would be utilized as opposed to a chloride zinc bath for certain purposes. Whereas the use of a carbon support, for example, has proved satisfactory in combination with a zinc sulfate bath in the past, the combination anode-anode support, in accordance herewtih, provides much more satisfactory and efficient electroplating merely because there is much lower contact resistance to the current passing between the anode and the anode support combined with no current loss from the support to the solution, thus providing much more efficient electroplating operation.

Whereas, the invention herein has proved particularly appropriate and highly desirable for electroplating of zinc in strip line electroplating, it is to be understood that this invention is not limited merely to the electroplating of zinc. It has been found that the invention, in accordance herewith, has proved highly satisfactory, also, for strip line tin electroplating. For example, in utilizing in the combination of a tin bath containing halides, as well known, with a tin anode and an anode support comprised essentially of tantalum there is a striking reduction almost to the point of elimination of oxidation of stannous to stannic tin on the anode support, while simultaneously providing for the use of high current densities and the absence of side reactions.

As is well known, when the usual prior art carbon anode support is used in combination with a tin anode for strip line with electroplating, a moss-like powdery tin sediment is collected on the support at the support-solution interface, which is bi-polar tin. Whereas there is no evolution of chlorine gas as in the case with zinc electroplating, there is oxidation in solution with the evidence being the sediment noted above which is an indication of some power loss during operations. Furthermore, this is an indication of a portion of the amount of tin lost in the sludge which collects in the bottom of halogen tin baths in strip line electroplating, as well known. For example, the amount of deposit collected as the bi-polar tin on the anode support is equal to a corresponding amount of stannic tin in the sludge collecting in the bottom of the bath. These two reactions may be characterized as follows:

| | |
|---|---|
| Bi-polar Support Sediment | $Sn^{+2} \xrightarrow{\text{reduction}} Sn^{\circ}$ |
| Sludge | $Sn^{+2} \xrightarrow{\text{oxidation}} Sn^{+4}$ |

With the combination, in accordance herewith, of the tin anode and a support surface comprising essentially tantalum in conjunction with a tin bath containing halides in strip line electroplating of tin, the reduction of the accumulation of bi-polar tin on the anode support is such that there is almost no sediment collected on the support. Obviously, with the arrangement, in accordance herewith, therefore, there is essentially an elimination of electrochemical oxidation in solution thus reducing the amount of tin lost in the sludge as well as in the form of bi-polar tin on the anode support, thus increasing the efficiency of the arrangement in accordance herewith by as much as 15%. When one realizes the huge quantities of tin which may be utilized in mass production operations for tin electoplating in a strip line operation, such an increase in efficiency becomes even more striking.

Accordingly, it is one object of this invention to provide methods and apparatus for the efficient electroplating of zinc in strip line operations while utilizing a zinc chloride bath and simultaneously avoiding chlorine evolution. In addition, it is another object of this invention to provide high speed zinc electroplating in strip line operations while simultaneously providing a thickness of electroplate which is appropriate for mass production commercial operations in the automobile industry where a particular desired zinc plating thickness is necessary for the protection of the final coated parts in the environment in which they are to be used.

It is a further object of this invention to provide methods and apparatus for strip line zinc electroplating utilizing an acid zinc bath, such as the zinc sulfate bath in which a lower contact resistance is achieved between the anode and the anode support therefor thus providing enhanced efficiency of the electroplating operations. A further object of this invention is to provide methods and apparatus for strip line electroplating of tin in combination with an acid tin bath in which the accumulation of bi-polar tin on the anode support is substantially avoided because of prevention of oxidation in solution of stannous to stannic tin on the support, simultaneously with a substantial reduction in the amount of tin accomulating in the sludge in such baths.

In addition, it is an object of this invention to provide methods and apparatus for strip line electroplating of metals, including tin and zinc in high speed mass production operations simultaneously with the utilization of high current density, high conductivity baths and increased efficiency.

In considering generally the conditions in connection herewith, which conditions are more specifically set forth below, one may note that applied DC line voltages of up to 40 volts may be used in accordance herewith for tin electroplating for example, with substantial elimination of current loss and no breakdown of the oxide film formed at the solution-support interface. This contrasts greatly with the usual applied line voltae in tin strip line electroplating of between about 21–24 volts.

It should be noted, further, that higher initial applied voltages provide thicker oxide film coatings on the anode support, in accordance herewith, thus providing enhanced protection during operation by avoidance of passage of current through the support-solution interface, thus avoiding the problems noted above in the prior art applications of strip line electroplating.

With the foregoing and additional objects in view, this invention will now be described in more detail, and other objects and advantages thereof will become apparent from the following description, the accompanying drawings, and the appended claims.

IN THE DRAWINGS

Figure 1:
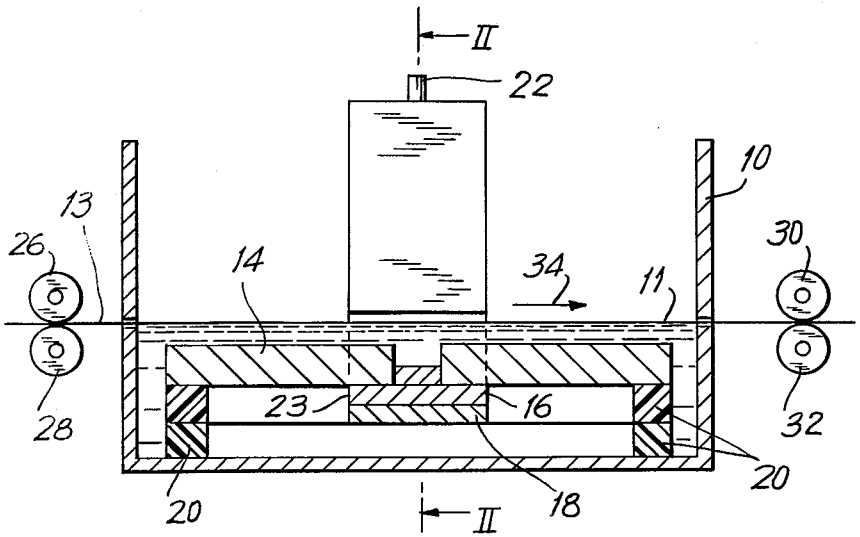

FIG. 1 is a somewhat diagrammatic longitudinal sectional view of apparatus embodying and for accomplishing this invention and showing an arrangement of anode structure, in accordance herewith, as it is disposed in a strip line for electroplating; and FIG. 2 is a section along the line II—II of FIG. 1.

Referring to the drawings, in which like reference characters refer to like parts throughout the several views thereof, an illustrative embodiment of apparatus for practicing this invention is somewhat diagrammatically depicted as having a strip line electroplating tank 10 in which is disposed a plating solution 12, the upper level of which is designated 11. Tank 10 is of any material non-reactive to the plating solution, such as, for example, a metallic tank with a non-reactive coating, all as well known.

The constituents of this solution will depend upon which metal is being electroplated on the strip passing through the apparatus. As is shown in FIG. 1, a strip 13 is passing continuously through the plating solution 12 along the upper level 11 thereof, the strip 13 being the metal which is to be electroplated. At the strip entrance end of tank 10, strip 13 travels between metal contact roll 26 and backup roll 28. At the exit end, strip 13 travels between metal contact roll 30 and backup roll 32. Thus, current is supplied at anode terminal 22, the strip 13 is the cathode and the circuit is completed through contact rollers 26 and 30.

As is shown in both FIGS. 1 and 2, the anode is in the form of a plurality of individual anodes 14. Anodes 14 are arranged along the bottom of the apparatus, the anodes being of the metal which is to be plated on strip 13 moving continuously along above the anode. As is best shown in FIG. 2, the anodes are arranged in the form of individual pieces or bricks which are added to the left hand side in FIG. 2 and are gradually moved toward the right hand side. With such an arrangement, as is well known, as the anode portions are used up they are moved to the right and new anodes are added so as to maintain an even level between the upper surface of the anodes 14 and the strip 13 passing above it. Accordingly, as is shown in FIG. 2, the anode support 16 is arranged in inclined fashion below the anodes in order to provide for or accommodate the different sized pieces of anode as they are moved along the anode support from the left to the right, as is shown in FIG. 2. In accordance herewith, the anode support 16 is comprised essentially of a member selected from the group consisting of tantalum, niobium, and mixtures thereof.

As is well known, below anode support 16 is a further anode sub-support 18 of the metal being plated which is covered or protected from solution except for the interface which is the bottom support surface all is well-known manner. Upright 21 is in contact with sub-support 18, and as in the embodiment shown is an extension of sub-support 18, and has disposed thereon the positive terminal 22 for connecting the apparatus to a source of current, as well known, but not shown for clarity, because the source of current does not form a part of the invention. It should be understood, however, that it is within the purview of this invention that support 16, sub-support 18 and extension 21 can be a single component, all in well-known manner. With such an arrangement, the single component may be comprised essentially of a member selected from the group consisting of tantalum, niobium and mixtures thereof, or the entire surface of the single component may be coated with such member, in accordance herewith.

As is shown in both FIGS. 1 and 2, the anode-anode support structure is disposed on blocks 20 which may be of any configuration as long as they serve to hold the structure away from the floor of tank 10. Blocks 20 may be of any well-known material which is non-reactive to the plating solution, such as Micarta, for example.

In operation, current passes from the source, not shown, through the positive terminal 22 and upright 21 to sub-support 18 and from there to support 16, and to anode 14. As is obvious, strip 13 is the cathode and receives a coating of the metal from solution 12. As noted above, when voltage is first applied to the arrangement in accordance herewith, an oxide coating is formed at the anode support 16-solution 12 interface, such as 23 in FIG. 1 or 24 FIG. 2. Because of this, no current passes through this interface. Thus, the current takes the path of least resistance to the anodes 14 through the solution 12 to cathode 13 which is the strip being plated. Because of the oxide coating formed on the surfaces 23 and/or 24 and if it is assumed that anodes 14 and anode subsupport 18 are zinc for plating zinc on strip 13, there is no electrochemical reaction between anode support 16 and the solution 12, which may be a chloride zinc bath, thus preventing chlorine evolution by electrochemical reaction of the solution 12 with the anode support 16 comprised essentially of a member selected from the group consisting of tantalum, niobium, and mixtures thereof.

As purely illustrative of the results achieved in accordance herewith, one may note the results in Tales I, II and III below in which typical voltages are noted for materials selected for use as the anode in a zinc chloride electrolyte. These typical voltages are those required to pass current to the solution from the anode support materials in an electrolytic cell.

It is to be understood, however, that these examples are being presented with the understanding that they are to have no limiting character on the broad disclosure of the invention as generally set forth herein and as directed to men skilled in the art.

In order to obtain the results noted in Table I, an electrolytic test was made in a 3 × 4 inch Lucite cell holding 350 ml. of solution at room temperature and with a pH of 3.0. The electrolyte contained zinc chloride in the amount of 100 g/l, and ammonium chloride at 150 g/l. A steel cathode was used as the metallic substrate to be coated, whereas the anode was one of the substances noted in Table I and being in the form of strips 1 × 4 inches immersed 2 inches in the solution. A DC power source was used with an appropriate voltmeter and ammeter connected in the line to determine the voltage at which current passed to the solution from the anode support substance being tested as an anode.

TABLE I

| ANODE SUPPORT SUBSTANCE | RESULTS |
|---|---|
| Carbon | Chlorine evolution at 2 volts |
| Titanium | Corrosion at 7 volts |
| Niobium | Corrosion at 13 volts |
| Tantalum | No effect at 15 volts |

It should be noted here that strip line voltages are usually 12 volts and above, and therefore, if the anode becomes polarized titanium would dissolve, thus contaminating the bath solution. By contrast, tantalum, for example, would not.

Tables II and II below show the individual readings for niobium and tantalum, respectively, which provide the data for Table I.

TABLE II

| 1" × 4" strip Niobium Anode Steel Cathode 2 inch immersion | |
|---|---|
| VOLTS | RESPONSE |
| 7.0 | No passage of current |
| 8.0 | No passage of current |
| 9.0 | No passage of current |
| 10.0 | No passage of current |

TABLE II-continued

| 1" × 4" strip Niobium Anode Steel Cathode 2 inch immersion | |
|---|---|
| VOLTS | RESPONSE |
| 11.0 | No passage of current |
| 12.0 | Momentary, then current stops |
| 13.0 | Passes current |

TABLE III

| 1" × 4" strip Tantalum Anode Steel Cathode 2 inch immersion | |
|---|---|
| VOLTS | RESPONSE |
| 2.5 | Momentary |
| 3.0 | Momentary |
| 3.5 | Momentary |
| 4.0 | Momentary |
| 5.0 | Momentary |
| 6.0 | Momentary |
| 7.0 | Momentary |
| 8.0 | Momentary |
| 9.0 | Momentary |
| 10.0 | Momentary |
| 11.0 | Momentary |
| 12.0 | Momentary |
| 13.0 | Momentary |
| 14.0 | Momentary |
| 15.0 | Momentary |
| 16.0 | Current breakthrough |

As further illustrative of the results achieved in accordance herewith, a comparison was made in a parallel circuit arrangement using an anode of zinc in accordance herewith, and utilizing a carbon anode connected with the zinc anode in the circuit as the most representative prior art material. One may note the results of this experiment in Table IV below. In this experiment, a representative chloride zinc bath solution was used of 100 g/l $ZnCl_2$ and 150 g/l $NH_4Cl$, with the pH of the solution being 3.0 and the temperature being about 150° F. (65.6° C.). In the Table, ASF means amperes per square foot as current density.

TABLE IV

| TOTAL CURRENT (Amps.) | ZINC ANODE Current (Amps.) | ZINC ANODE CD ASF | CARBON ANODE Current (Amps.) | CARBON ANODE CD ASF | CARBON ANODE Chlorine Noted |
|---|---|---|---|---|---|
| 1.0 | 1.0 | 48 | 0 | | |
| 2.01 | 2.04 | 97.4 | — | | |
| 2.99 | 3.04 | 154.4 | — | | |
| 3.94 | 3.99 | 191.5 | — | | |
| 4.98 | 4.88 | 234.2 | .1 | 4.8 | $Cl_2$→ |
| 5.96 | 5.58 | 267.8 | .38 | 18.2 | $Cl_2$→ |
| 8.00 | 7.06 | 338.9 | .94 | 45.1 | $Cl_2$→ |
| 8.94 | 7.58 | 363.8 | 1.36 | 65.3 | $Cl_2$→ |

As is apparent from Table IV, chlorine evolution was noted at the carbon anode when the zinc anode current density was around 234 ASF, which evolution is typical of the prior art difficulty.

As further illustrative of the process and apparatus, in accordance herewith, certain non-plating tests were carried out utilizing the combination anode structure herein in combination with a chloride zinc bath. In these tests, a plastic coated tank was used of a size 12 × 12 × 30 inches with a steam line connected thereto in order to maintain a proper temperature level. Zinc anodes were prepared of a size 2.0 × 2.5 × 16 inches and weighing approximately 20 pounds. Thereafter, subsupport blocks were prepared of a size 3 × 4 × 1.5 inches of the various materials to be plated (zinc). The prepared support blocks were machined, drilled, and tapped for current and voltage leads. Thereafter, a 4 × 5 × 0.032 inches sheet of the particular niobium and/or tantanlum material to be tested was prepared by cleaning with various commercial cleaners and affixed with a lead for measuring the voltage drop across the sheet when it is placed between the slab zinc anode and the zinc anode sub-support below the particular metallic tantalum and/or niobium support interposed therebetween in the sandwich structure as described and illustrated above. The source of current to the test apparatus was from a rectifier having a range of 0–500 amps. The solution placed in the tank was a chloride zinc bath containing 100 g/l $ZnCl_2$ and 150 g/l $NH_4Cl$, with the bath having a pH of 3.0 and with the temperature being maintained at approximately 150° F. (65.6° C.). Table V is an indication of the results achieved in these tests. In this Table, the voltage is measured between the zinc anode and the tantalum support. In this test, various amperages were passed and voltage measurements were taken at each amperage level to make a comparison of contact resistance. As is readily apparent from a review of Table V, there is relatively little resistance.

TABLE V

| | CONTACT RESISTANCE | |
|---|---|---|
| Amps. | Volts Zn Anode to Ta Support | Ohms Zn Anode to Ta Support |
| 50 | 0.015 | 0.00030 |
| 100 | 0.030 | 0.00030 |
| 150 | 0.050 | 0.00033 |
| 200 | 0.075 | 0.00038 |
| 250 | 0.095 | 0.00038 |
| 300 | 0.120 | 0.00040 |
| 350 | 0.140 | 0.00040 |
| 400 | 0.160 | 0.00040 |
| 450 | 0.175 | 0.00039 |
| 500 | 0.195 | 0.00039 |
| 50 | 0.015 | 0.00030 |

It should be noted further that in the Table V, there was no evidence of the evolution of chlorine gas in any of these tests at the solution-tantalum interface.

As further illustrative of the results achieved in accordance herewith, one may note the results of Table VI below in which a further test was carried out in a plating tank of a size 12 × 30 × 12 inches. The same sandwich arrangement anode-anode support structure was disposed with the anode support being tantalum and the anode being zinc with the sub-support being zinc. A plating bath of 44.2 liters of a zinc chloride solution containing 100 g/l zinc chloride and 150 g/l ammonium chloride was disposed in the tank. The pH of the plating bath was adjusted to 3.0 with the addition of HCl. The anode areas of the zinc anode was 134 square inches (0.93 square feet). At the end of the test, the pH was 3.5. The temperature varied from 126°–130° F. (52°–54° C.) during the test.

In this test, the anode current density in amperes per square foot is given in relationship to various levels of amperage with the voltage being measured from the tantalum support to the zinc anode. As is readily apparent from a review of the results noted in Table VI, the voltage was extremely small regardless of the level of amperage.

TABLE VI

| Amps. | Anode Current Density ASF | Volts Ta Support to Zn Anode |
|---|---|---|
| 100 | 107 | .3 |
| 200 | 215 | .34 |
| 300 | 323 | .36 |
| 400 | 430 | .4 |

Tables VII and VIII below are further illustrations of the results achieved in accordance herewith in which tantalum life tests were carried out with the same sandwich structure noted above and with the same zinc chloride solution in the amount of 60 liters being used as the bath. As is apparent in this life test, the amperage was maintained at a constant level over a period of time.

It is to be understood, however, that these Tables only represent an indication of the results of the life tests which were conducted over extended periods for a total of about 14,700 ampere-hours, the documentation of which would be unnecessarily prolix here. The primary object of these tests was to determine if any attack occurred and if chlorine was given off during polarizing periods.

In the Tables, ΔTZT and ΔTZB is an indication of contact resistance, with ΔTZT being the voltage difference between the zinc anode and the tantalum support, while ΔTZB is the voltage difference between the tantalum support and the zinc sub-support. As is apparent from Table VII, the voltmeter used was not sensitive enough to detect voltage, whereas the ΔTZB readings in Table VIII were taken with the more sensitive Keithley 61OC Electrometer. As will be apparent, there is no indication of attack of the tantalum at the tantalum-solution interface nor is there evidence and/or indication of chlorine gas evolution.

TABLE VII

| | 300 AMP - TANTALUM LIFE TEST | | | | | | |
|---|---|---|---|---|---|---|---|
| AMPS | TIME HOURS-MINUTES | CELL VOLTAGE VOLTS | ΔTZT VOLTS | ΔTZB VOLTS | TEMP ° C. | pH | ADJ pH |
| 300 | 0 | 4.8 | 0.355 | 0 | 65 | 2.8 | |
| 300 | $40^m$ | 4.4 | 0.305 | 0 | 65 | 3.2 | 2.8 |
| 300 | $1^{hr}$ | 4.2 | 0.310 | 0 | 68 | 3.5 | 2.8 |
| 300 | $1^{hr} - 40^m$ | 4.2 | 0.325 | 0 | 66 | 3.5 | ADJ. |
| 300 | $2^{hr} - 11^m$ | 4.2 | 0.110 | 0 | 65 | 2.8 | |
| 300 | $2^{hr} - 40^m$ | 3.8 | 0.165 | 0 | 65 | 4.0 | ADJ. |
| 300 | $3^{hr} - 10^m$ | 3.6 | 0.125 | 0 | 65 | 3.2 | |

TABLE VIII

| AMPS | TIME HOURS-MINUTES | CELL VOLTAGE VOLTS | ΔTZT VOLTS | ΔTZB VOLTS | TEMP. ° C. | pH |
|---|---|---|---|---|---|---|
| 300 | 0 | 6.2 | 0.300 | 0.023 | 50 | 2.2 |
| 300 | $25^m$ | 5.7 | 0.305 | 0.017 | 66 | 2.4 |
| 300 | $1^{hr} - 30^m$ | 4.3 | 0.320 | 0.017 | 70 | 3.4 |
| 300 | $2^{hr}$ | 4.1 | 0.320 | 0.017 | 68 | 2.8 |
| 300 | $2^{hr} - 30^m$ | 3.3 | 0.300 | 0.017 | 65 | 3.3 |
| 300 | $3^{hr}$ | 3.0 | 0.310 | — | 65 | 3.3 |
| 300 | $3^{hr} - 30^m$ | 3.6 | 0.340 | 0.019 | 65 | 3.1 |
| 300 | $4^{hr}$ | 2.6 | 0.305 | — | 65 | 3.7 |

TABLE VIII-continued

| AMPS | TIME HOURS-MINUTES | CELL VOLTAGE VOLTS | ΔTZT VOLTS | ΔTZB VOLTS | TEMP. °C. | pH |
|---|---|---|---|---|---|---|
| | | 4.0 | | | | |
| 300 | $4^{hr}$ - $30^{m}$ | 3.0 | 0.310 | 0.016 | 65 | 3.2 |

Table IX is an indication of the results achieved in accordance herewith when a zinc sulfate-type bath is used for electroplating zinc in a strip line operation and shows the increased efficiency with the arrangement in accordance herewith in those instances where a zinc sulfate bath may be more appropriate than a zinc chloride bath for certain applications in which speed and quantitative production are not critical. In this arrangement, a polyvinyl chloride coated tank was used measuring 1 × 1 × 2.5 feet. 53 liters of a plating solution was used containing 236 g/l $ZnSO_4.H_2O$, 61 g/l $MgSO_4.7H_2O$, and 72 g/l $Na_2SO_4$. The zinc anode measured 15.5 × 1.75 × 1.25 inches with the anode area being 93 square inches. The various designations for Table IX are:

I — Current — amperes
CV — Cell Voltage
AZ — Zinc Anode to Tantalum Support — volts
SZ — Zinc Sub-support Block to Tantalum Support — volts The efficiency of the arrangement in accordance herewith is readily apparent from a review of Table IX and a comparison of the AZ - SZ voltages as an indication of the reduced resistance at the anode-anode support interface.

TABLE IX

| TIME | pH | °F | I A | CV VOLTS | AZ VOLTS | SZ VOLTS |
|---|---|---|---|---|---|---|
| 14:00 | 2.83 | 149 | 132 | 9.15 | 0.365 | 0.010 |
| 14:10 | 2.85 | 149 | 144 | 9.20 | 0.376 | 0.010 |
| 14:20 | 2.87 | 149 | 132 | 9.27 | 0.350 | 0.010 |
| 14:30 | 2.88 | 150 | 144 | 9.23 | 0.373 | 0.011 |
| 14:40 | 2.90 | 150 | 144 | 9.25 | 0.385 | 0.010 |
| 14:50 | 2.91 | 150 | 156 | 9.03 | 0.413 | 0.011 |
| 15:00 | 2.94 | 151 | 168 | 8.91 | 0.402 | 0.012 |
| 15:10 | 2.94 | 152 | 156 | 8.99 | 0.383 | 0.012 |
| 15:20 | 2.96 | 153 | 192 | 8.43 | 0.365 | 0.016 |
| 15:30 | 2.99 | 155 | 228 | 8.29 | 0.388 | 0.016 |
| 15:40 | 2.99 | 157 | 264 | 7.78 | 0.393 | 0.012 |
| 15:50 | 3.02 | 160 | 288 | 7.61 | 0.421 | 0.014 |
| 16:00 | 3.07 | 163 | 300 | 7.44 | 0.437 | 0.015 |

When electroplating in a strip line with tin and utilizing a tin bath containing halides, as opposed to electroplating with zinc, the problems inherent with the use of the prior art carbon anode support are substantially the same, except that instead of chlorine gas evolution there is an oxidation reaction in solution. Further, this oxidation of stannous to stannic tin on the anode support results in the obvious accumulation on the anode of a bi-polar tin in the form of a moss-like powdery sediment. By contrast, with the arrangement in accordance herewith such oxidation reactions in solution are substantially eliminated.

As illustrative of the results achieved in accordance herewith for strip line electroplating of tin utilizing a tin bath containing halides, one may note the results below. The apparatus utilized was very similar to that described in Table V above, except that in this case two tin baths containing halides were utilized with the two being connected electrically in series to compare the stannic tin build-up using a carbon support versus a tantalum support.

In these tests, 57 liters of bath solution were used with the components thereof as follows:

| | | |
|---|---|---|
| $Na_4Fe(CN)_6\ 10H_2O$ | 1.2 | g/l |
| $NaHF_2$ | 17.2 | g/l |
| NaF | 34.4 | g/l |
| $SnCl_2$ | 40 | g/l |
| NaCl | 45 | g/l |
| Addition agent | 7 | ml/l |

The addition agent may be any well-known material such as, for example, a polyethylene glycol composition such as that disclosed in U.S. Pat. No. 2,457,152.

In these tests, after 4924 ampere-hours the stannic tin build-up for the tantalum support test was reduced by 14.6% compared to the carbon test. Furthermore, visual observations showed only a slight build-up of bi-polar tin on the tantalum support surface and the anode surface, whereas there was an obvious large accumulation on the exposed surface of the carbon support.

Also, the tin anode to tantalum support voltages were 0.3 to 0.7 volts while the tin anode to carbon support voltages were normally higher at 0.4 to 1.35 volts.

As further representative of the results achieved in accordance herewith for strip line electroplating with a tin bath containing halides, one may note Table X below in which the anode current at various voltages is reported for various anode support materials including the already known carbon support material. In this test, the various materials reported were utilized as 1 inch wide anodes immersed 2 inches whereas the cathode used was 2 inch wide nickel plated steel immersed 3 inches.

The bath utilized was 500 ml. of tin plating bath containing halides as follows:

| | | |
|---|---|---|
| $SnCl_2$ | 57 | g/l |
| $NaHF_2$ | 20 | g/l |
| NaF | 40 | g/l |
| NaCl | 45 | g/l |
| $Na_4Fe(CN)_6 . 10H_2O$ | 1.2 | g/l |
| Addition agent | 7 | ml/l |

The temperature during the tests was maintained at between about 144°-150° F. (62°-65.6° C.) and the pH was about 3.0.

TABLE X

| | VOLTS | | | | | | | |
|---|---|---|---|---|---|---|---|---|
| | 0.1 | 0.5 | 1.0 AMPERES | 2.0 | 10.0 | 20.0 | 30.0 | 40.0 |
| Carbon | — | 0.004 | 0.280 | 1.6 | — | — | — | — |
| Titanium | 0.8 | 2.0 | Anode severly attacked | | | | | |
| Niobium | — | 0.4 | 1.0 | — | 1.1 | 1.3 | 1.66 | 2.34 |
| Tantalum | — | 0.01 | 0.01 | 0.03 | 0.07 | 0.05 | 0.05 | 0.04 |

It should be understood that whereas the most enhanced results are achieved for tin strip line electroplating, in accordance herewith, when the tin bath is a halogen bath this invention is not so limited and other halogen-containing baths may also be used, as well understood. Furthermore, it should be understood that it is within the purview of this invention to utilize acid tin plating baths, all in well-known manner.

Accordingly, and as will be apparent from the foregoing, there are provided in accordance herewith, methods and apparatus for the high speed wire and/or strip line electroplating of metals such as zinc and tin in a manner which provides simultaneously a desired thickness of plate for use in highly corrosive environment such as, for example, automobile parts, while at operating levels of sufficient current density so that the plating lines may be maintained at sufficient speeds to make the operation advantageous commercially. In addition, lead coatings may be achieved utilizing lead as the anode in the combination in accordance herewith.

Further, because of the arrangement herein, baths containing halogens may be utilized for electroplating substantially in the absence of halogen gas evolution thus making the environment of such operations acceptable for the operators thereof. Also, in the utilization of the particular anode structure herein, there is substantially reduced resistance to current passing between the various interfaces of the sandwich structure thus enhancing the overall efficiency of operations utilizing the structure herein. Moreover, in tin strip line electroplating utilizing the structure herein there is a reduction in the loss of tin in solution thus reducing the amount of tin necessary to achieve a particular amount of plate.

Obviously, all of the above serves to make the methods and apparatus in accordance herewith highly advantageous commercially.

While the methods and apparatus herein disclosed form preferred embodiments of this invention, this invention is not limited to those specific methods and apparatus, and changes can be made therein without departing from the scope of this invention which is defined in the appended claims.

We claim:

1. An anode structure for use in wire and strip line electroplating which comprises an anode of the metal to be electroplated selected from the group consisting of tin, zinc, and tin-zinc alloys; a support for said anode and disposed adjacent thereto, said support comprised essentially of at least one member selected from the group consisting of tantalum, niobium and mixtures thereof; and a sub-support disposed adjacent said support on the side thereof opposite said anode, said sub-support being comprised of the metal to be electroplated.

2. An anode structure as recited in claim 1 in which said metal to be electroplated is zinc.

3. An anode structure as recited in claim 1 in which said metal to be electroplated is tin, and the said support is essentially tantalum.

4. An anode structure for use in wire and strip line electroplating which comprises an anode of the metal to be electroplated selected from the group consisting of tin, zinc, and tin-zinc alloys; a support for said anode and disposed adjacent thereto, with at least the surface of said support comprised essentially of a member selected from the group consisting of tantalum, niobium and mixtures thereof; and a sub-support disposed adjacent said support on the side thereof opposite said anode, said sub-support being comprised of the metal to be electroplated.

5. An anode structure as recited in claim 4 in which said metal to be electroplated is zinc.

6. An anode structure as recited in claim 4 in which said metal to be electroplated is tin, and the said support surface is essentially tantalum.

* * * * *